US010799416B2

(12) United States Patent
Taves

(10) Patent No.: US 10,799,416 B2
(45) Date of Patent: Oct. 13, 2020

(54) SELF-TREATING UPPER NECK SYSTEM FOR THERAPEUTIC MOBILIZATION

(71) Applicant: Jonathan David Taves, Colorado Springs, CO (US)

(72) Inventor: Jonathan David Taves, Colorado Springs, CO (US)

(73) Assignee: Jonathan Taves, Colorado Springs, CO (US)

( * ) Notice: Subject to any disclaimer, the term of this patent is extended or adjusted under 35 U.S.C. 154(b) by 199 days.

(21) Appl. No.: 15/711,562

(22) Filed: Sep. 21, 2017

(65) Prior Publication Data

US 2019/0083349 A1 Mar. 21, 2019

Related U.S. Application Data

(60) Provisional application No. 62/445,224, filed on Jan. 11, 2017.

(51) Int. Cl.
*A61H 1/02* (2006.01)
*A61H 1/00* (2006.01)

(52) U.S. Cl.
CPC ..... *A61H 1/0296* (2013.01); *A61H 1/00* (2013.01); *A61H 1/0218* (2013.01); *A61H 1/0222* (2013.01); *A61H 2201/0134* (2013.01); *A61H 2201/0192* (2013.01); *A61H 2201/1253* (2013.01); *A61H 2201/14* (2013.01); *A61H 2201/1604* (2013.01); *A61H 2201/1607* (2013.01); *A61H 2201/169* (2013.01); *A61H 2201/1664* (2013.01); *A61H 2201/1671* (2013.01); *A61H 2203/0456* (2013.01); *A61H 2205/02* (2013.01); *A61H 2205/04* (2013.01)

(58) Field of Classification Search
CPC ..... A61H 1/0296; A61H 1/0222; A61H 2205/04; A61H 2201/0203
See application file for complete search history.

(56) References Cited

U.S. PATENT DOCUMENTS 4,971,043 A * 11/1990 Jones ..... A61H 1/0218 602/36
5,024,214 A * 6/1991 Hayes ..... A61H 1/0218 482/95
5,135,537 A * 8/1992 Lamb ..... A61H 1/0222 601/58
5,451,202 A * 9/1995 Miller ..... A61H 1/0218 602/35
6,113,563 A * 9/2000 D'Amico ..... A61H 1/0218 602/32

(Continued)

*Primary Examiner* — Kristen Matter

(57) ABSTRACT

One embodiment of a self-treating upper neck system for therapeutic mobilization and of the type allowing for restoration of C1-2 rotation by means of placing repeated passive mobilizations to the upper neck. This embodiment accomplishes this by having two stoppers (12*a* and 12*b*) that fix the C2 vertebra by placing a force through the posterior aspect of the C2 transverse processes. The force is applied by the patient via an elastic head strap (20) attached to a rope (22) that is looped through pulleys and eventually terminates with handles (24*a* and 24*b*) on each side. With the patient resting his/her head on a foam cushion (14) secured to the base of the apparatus (10), they use the rope (22) and pulley system to generate the precise magnitude and direction of forces necessary to repeatedly mobilize the C1-2 segments.

1 Claim, 2 Drawing Sheets

(56) References Cited

U.S. PATENT DOCUMENTS

| | | | | |
|---|---|---|---|---|
| 7,862,526 | B1 * | 1/2011 | Skowron | A61H 1/0218 602/18 |
| 8,613,690 | B1 * | 12/2013 | Thompson | A63B 23/025 482/10 |
| 8,657,774 | B1 * | 2/2014 | Fisher | A61H 1/0292 602/32 |
| 9,216,312 | B2 * | 12/2015 | Richardson | A63B 21/00043 |
| 9,402,759 | B2 * | 8/2016 | Bonutti | A61F 5/042 |
| 2004/0058780 | A1 * | 3/2004 | Edgeton | A63B 21/055 482/10 |
| 2005/0043154 | A1 * | 2/2005 | Atrizadeh | A63B 21/0004 482/124 |
| 2008/0119331 | A1 * | 5/2008 | Zylstra | A63B 21/0552 482/10 |
| 2012/0265114 | A1 * | 10/2012 | Kang | A61F 5/042 602/35 |
| 2013/0053225 | A1 * | 2/2013 | Meyer | A63B 21/0552 482/124 |
| 2017/0239216 | A1 * | 8/2017 | Sadar | A61K 31/495 |

* cited by examiner

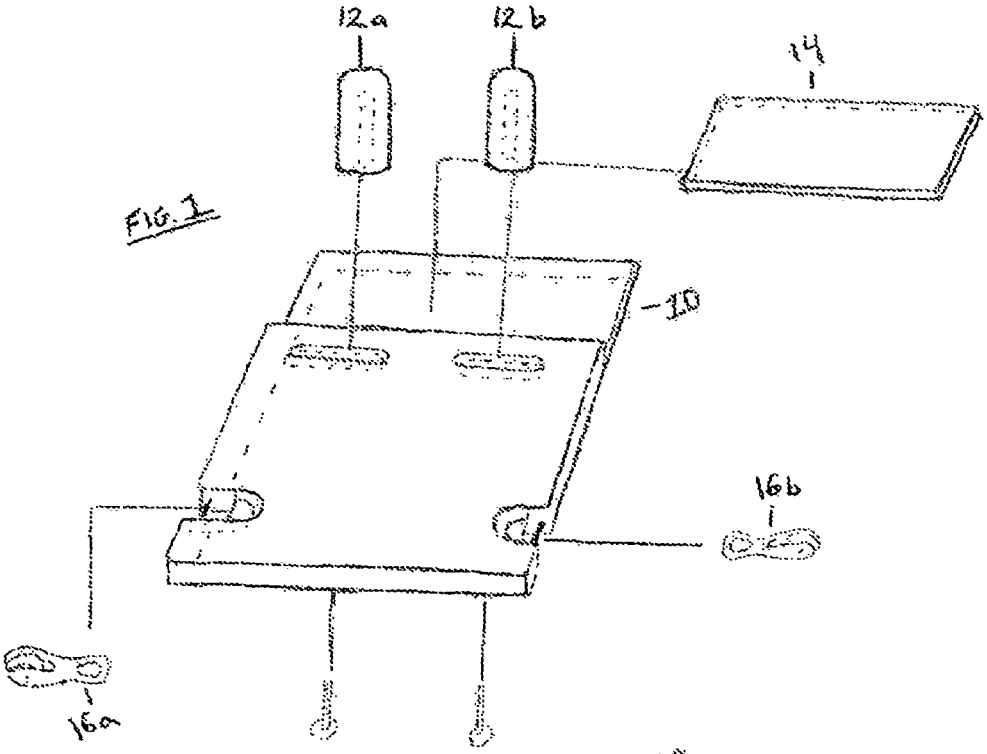
FIG. 1
FIG. 2
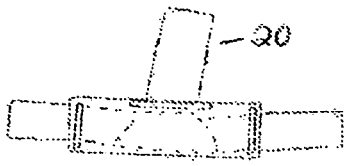
FIG. 3
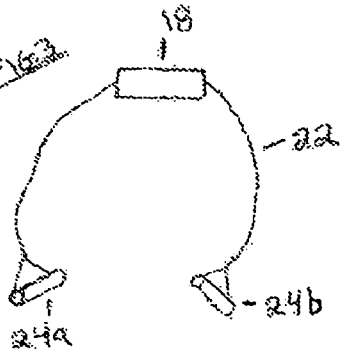

SELF-TREATING UPPER NECK SYSTEM FOR THERAPEUTIC MOBILIZATION

CROSS-REFERENCE TO RELATED APPLICATIONS

This application claims the benefit of provisional patent application Ser. No. 62/445,224, filed 2017 Jan. 11 by the present inventor.

BACKGROUND

Prior Art

The following is a tabulation of some prior art that presently appears relevant:

| U.S. Patents | | | |
|---|---|---|---|
| Pat. No. | Kind Code | Issue Date | Patentee |
| 6,171,273 | B1 | 2001 Jan. 9 | Saunders |
| 5,569,175 | A | 1996 Oct. 29 | Chitwood |
| 5,498,218 | A | 1994 Aug. 10 | Proctor, Fuller |
| 9,192,503 | B1 | 2015 Nov. 24 | Peterson, Blaisdell |

| U.S. Patent Application Publications | | | |
|---|---|---|---|
| Publication Nr. | Kind Code | Publ. Date | Applicant |
| 02016083968 | A1 | 2016 Jun. 2 | Alexander |

Nearly 90% of the population has reported to having a headache within their lifetime. Tension-type headaches are the most prevalent form of a headache with lifetime prevalence of 52%. Naturally, with such a high prevalence of tension-type headache pain, there are various approaches to treatment. Presently, treatments include pharmaceutical headache and pain relievers, therapeutic massage, chiropractic care, physical therapy and an array of self-treatment devices When assessing which treatment approach is most effective we should first understand the underlying mechanism and from this we can know where long-term relief can be found. Whether due to poor posture, whiplash injury or trauma, tension is developed in the upper vertebral segments (C1-3) of the cervical spine and translated to the nerves, muscles and other sensitive tissues of the head and neck causing a headache. Most of these headaches start with a minor irritation at the base of the skull, with the pain eventually traveling up the head and possibly resting behind the eye. In order to stop this chain of events the loss of rotation in the first and second cervical vertebrae must be addressed.

When we rotate our neck, the C1-2 vertebral segments make up 50% of our total rotational movement (40-45 degrees). Following the prolonged poor posturing, or whiplash injury from a motor vehicle accident or a traumatic event, the C1-2 joint gradually stiffens up. This is the start of developed tension that will eventually lead to a tension headache. Therefore, we can deduct that an intervention geared to treat a tension-type headache will only find complete long-term resolution if it is able to restore the motion in the upper neck, namely C1-2 rotation. With that in mind, lets look at the available treatments.

First, pharmaceutical headache and pain relievers have met the public with varying degrees of success in curing headaches. However, the pharmaceutical products are deficient for a number of reasons. There is no evidence to suggest any medication can improve mobility in a joint. They do not relieve the same type of headaches in different people. People often build up immunity to these pharmaceutical products rendering them ineffective. Other people are allergic to these pharmaceutical products or cannot or do not want to ingest the chemicals in these pharmaceutical products. Also, the pharmaceutical products are aimed at curing generalized pain only, and cannot cure particular areas of pain.

Second, Physical Therapists, physicians, chiropractors and other health care providers have treated tension type headaches using various interventions. The most effective intervention of these practitioner's being manipulation and mobilization techniques to restore joint mobility. The problem is that a patient can have limited access to a provider for various reasons including a restrictive financial situation, a busy work schedule, plans to travel or relocate or difficulty with transportation to and from the clinic. This void is filled with self-treating devices that a patient can take home and continue to care for their tension-headache on their own time, without need of transportation and at a lower cost. The problem is that there is not a self-treatment device that is able to continue with cervical mobilization/manipulation to the restricted C1-2 joint outside of the clinic.

Take for example Saunders U.S. Pat. No. 6,171,273 (2001) as he discloses a traction type unit. The benefits of this include: distraction or separation of the vertebral bodies, a combination of distraction and gliding of the facet joints, tensing of the ligamentous structures of the spinal segment, widening of the intervertebral foramen and straightening of spinal curvature and stretching of the spinal musculature. While this provides benefit in the above areas you will notice it does not address the underlying mechanism for a tension headache, which is loss of motion. If a patient were to solely utilize a traction type device for a tension-type headache they would find only short-term relief Other examples of traction type patents include: U.S. Pat. No. 5,569,175 (1996) and U.S. Pat. No. 9,192,503 (1994)

Another example is Chitwood's U.S. Pat. No. 5,569,175 (1990 incorporating traction with a pivoting component. This does add to the traditional Saunders traction device performance, but fails to provide any mobilization that would restore proper motion in the upper cervical segments. Again this would only have short-term effects on headache pain and should only be seen as a way to provide temporary relief.

In addition, although not well understood in its function, Alexander's patent application 02016083968 (2016) has proposed an apparatus that can be used when sitting and supine that reduces neck tension secondary to poor sitting posture. This patent application describes a device to address headaches brought about from prolonged sitting with poor posturing. The application does not, however, speak of a device that will address the underlying cause of tension-type headache, which is a loss of motion in the upper cervical segments. This again may help with symptom management, but no long-term relief should be expected.

Aside from traction we have a slew of self-treatment devices geared at providing a therapeutic massage. Yet again, another intervention that provides short-term relief. Massage therapists have attempted to treat tension headaches over the years by focusing on reducing tension found in the muscles that assist with head and neck function. Many patients will agree that they leave feeling the headache pain is reduced but within several days they need another appointment as the headache returned.

One device that provides both traction and massage was designed by Peterson and Blaisdell U.S. Pat. No. 9,192,503 (2015) as they proposed a device that does well to reduce the need for hands on mobilization/manipulation from a skilled practitioner allowing the patient to self-treat. However, the design of this device is geared to provide massage to the base of the occipital ridge and there is no intention to provide restoration to a specific joint motion. With finger like projections the feel of the device would be similar to a mobilization provided from a practitioner, but due to the lack of movement provided while using the device, the effectiveness would only go so far as allowing for a soft tissue massage without effectively treating for the underlying joint restriction.

SUMMARY

In a first manifestation, the embodiment is comprised of a base platform that includes a cushion for the base of the skull to rest, two adjustable blocking pillars attached to the base platform that serve to block the desired cervical segment and a head strap attached to a rope slung through pulleys and attached to two handles that the patient is able to utilize for passive motion in order to restore desired motion.

Advantages

Accordingly, several advantages of one or more aspects are as follows: To provide a self-treatment device that ultimately addresses the underlying cause of tension-type headaches, namely, restoring motion in the upper cervical spine. This will be achieved through an embodiment that is low cost in order to be accessible to the majority of patients, easy to use for patients of varying ages and cognitive abilities, simple to fabricate and that emulates mobilization/manipulation from a provider.

DRAWINGS

Figures

In the drawings, closely related figures have the same number but different alphabetic suffixes.

FIG. 1 illustrates a first preferred embodiment cervical mobilization/manipulation apparatus designed in accord with the teachings of the present invention from an enlarged and projected view.

FIG. 2 illustrates a first preferred embodiment complete head strap with a plastic Velcro attachment.

FIG. 3 illustrates a rope with handles on each end and a rectangular Velcro attachment piece in the middle.

DRAWINGS

Reference Numerals

| | | | |
|---|---|---|---|
| 10 | Base of apparatus | 12a | Right stopper |
| 12b | Left stopper | 14 | Head cushion |
| 16a | Right pulley | 16b | Left pulley |

-continued

| | | | |
|---|---|---|---|
| 18 | Plastic head piece | 20 | Elastic head strap |
| 22 | Rope | 24a | Right handle |
| 24b | Left handle | | |

DETAILED DESCRIPTION

Figs. 1, 4 and 5

First Embodiment

Figure 4:
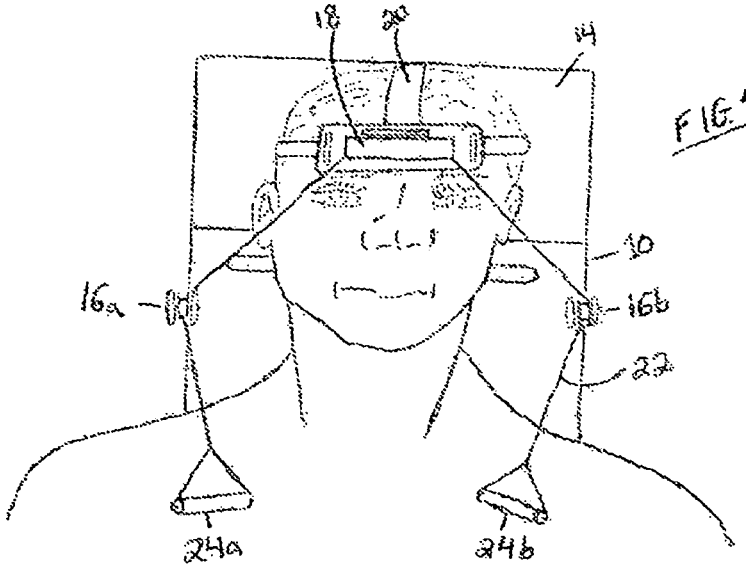
FIG. 4 illustrates the first preferred embodiment cervical mobilization/manipulation apparatus of FIG. 1 from a front view and in further operative combination with a patient.
Figure 5:
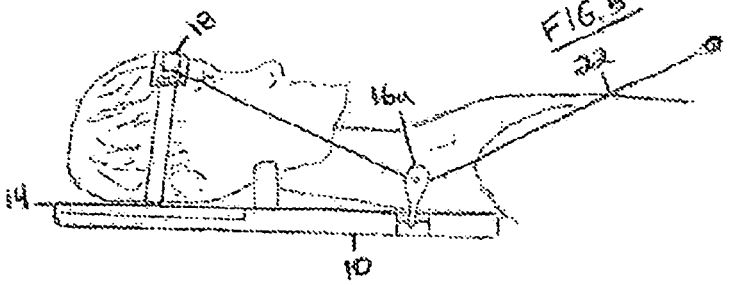
FIG. 5 illustrates the first preferred embodiment cervical mobilization/manipulation apparatus of FIG. 1 from a side view and in further operative combination with a patient.

One embodiment of the cervical mobilization/manipulation apparatus is illustrated in FIG. 1-3 (top view), FIG. 4 (top view in operative combination with a patient) and FIG. 5 (side view in operative combination with a patient). The cervical mobilization/manipulation apparatus has a base 10 of uniform cross section consisting of a rigid sheet of material that can serve as a sturdy platform for the additional features. The upper portion of the base 10 is cut to the depth in order to accommodate for a head cushion 14. In one embodiment this base is a rigid and durable plastic such as Acrylonitrile Butadiene Styrene (ABS) that can be either molded or fabricated for production. The head cushion in this embodiment may be durable foam such as neoprene, but is comfortable enough for a patient to rest his/her head on for at least 30 minutes.

Located on the base are two horizontal cut outs that allow for the stoppers 12*a* and 12*b* to be attached, each with a bolt from the undersurface of the base 10, and adjusted to accommodate the various neck sizes of the patient. In one embodiment the stoppers are a rigid and durable plastic such as Acrylonitrile Butadiene Styrene (ABS) that can be used with either molding or fabrication for production.

Also in this embodiment are two pulleys 16*a* and 16*b* attached to the base by metal rods. These rods bridge a half circle cut out on the side of the board near the bottom ⅓ of the base in order to secure each pulley 16*a* and 16*b*. The pulley's can be purchased online from www.e-rigging.com.

Operation

Fig. 1-5

The manner of using the cervical mobilization/manipulation apparatus to improve on the rotation found in the upper cervical spine is similar to manual therapy techniques practiced by practitioners in the clinic. Namely, just as a clinician would use a finger, each stopper 12*a* and 12*b* is placed at the posterior aspect of the C2 transverse process in order specifically mobilize the C1-2 segment. With the patient positioned properly the back of their head will rest on the foam pad 14 and the stoppers 12*a* and 12*b* will block the C2 segment from rotating.

Prior to or while in the supine position, the patient can fasten the head strap 20 using adjustable straps so that it fits snug around the head. With the rope 22 attached to the plastic rope piece 24 the patient is able to secure the plastic head piece 18 to the head strap 20 via two strips of adhesive Velcro fastened to the under surface of the plastic head piece 18 and the outward facing surface of the head strap 26.

Now that the patient is in the proper head position they will follow this with grasping the handles 24*a* and 24*b* attached to the rope 22 running through each pulley 16*a* and

16*b*. With this set-up the patient is able to provide a force that is directed in an inferior and lateral vector in order to provide rotation and nodding to the head. Rotation to the skull will automatically start to turn the C1 vertebrae and with the C2 vertebrae blocked by the stopper 12*a* and 12*b* there is a resultant mobilization or stretch placed on the muscle, ligaments and other anatomical structures that are restricting C1-2 rotation. The patient will then hold this mobilization for 2-3 seconds before releasing the stretch. This will be repeated every 1-2 seconds for upward of 15-20 minutes or as long as the patient can tolerate the activity. In addition to a mobilization into rotation, the angle of pull placed through the rope and onto the head will also provide a gaping effect to the joint located between the occiput and the atlas. This gaping or nodding function will provide several benefits as it will counteract the adaptive shorten that takes place secondary to poor posturing along with freeing up the neural pathways that are disrupted leading to tension type headache pain.

ALTERNATIVE EMBODIMENTS

There are various possibilities with regard to the relative disposition of the contours and materials used to fabricate or manufacture this cervical mobilization/manipulation apparatus.

Advantages

From the description above, a number of advantages of some embodiments of my cervical mobilization/manipulation apparatus become evident.

(a) With the use of inexpensive materials such as ABS plastic and neoprene foam it will permit a lower fabrication cost and pass the expense savings onto the patient allowing access to the majority of the population.

(b) Although some education may be required prior to use, the limited number of moving/adjustable parts will allow ease of use while fitting properly on a variety of head and neck sizes.

(c) Passive mobility of the neck is essential, as any active contraction of the neck musculature will block the C1-2 mobilization. The strap and pulley system allow for passive movement of the head and neck with the patient controlling the amount of force generated for comfort and effectiveness.

(d) In addition, the passive mobility and patient control allows for self-treatment with little to no risk of harm as the patient is generating a force through the neck below their threshold of pain tolerance.

(e) The plastic and foam materials are easily cleaned in between uses.

(f) The plastic and foam materials are durable and lightweight which provides for easy travel and an increased life span.

(g) The patient is allowed a low cost-alternative to skilled intervention by a health care practitioner when suffering from a tension headache.

(h) With 24/7 access to the device in the patient's home as opposed to expensive physical therapy or chiropractic visits 1-2×/week, the patient will find greater benefit and faster recovery times.

(i) Healthcare providers will have an alternative treatment approach that allows for convenience and low cost compared to traditional avenues of care.

CONCLUSION, RAMIFICATIONS, AND SCOPE

Accordingly, the reader will see that the cervical mobilization/manipulation apparatus of different embodiments can be used to treat tension type headache pain by mobilizing the C1-2 cervical joint safely and effectively. In addition, this device allows a provider with a tool to aid in the care of patients with tension-type headaches while empowering the patient to care for their symptoms with a safe, low-cost self-treatment approach. Furthermore, the cervical mobilization manipulation apparatus has the additional advantages in that:

- it permits the patient to increase the frequency of their care via a self-treatment approach.
- it provides a low cost alternative to repeated time consuming and expensive visits to providers who treat tension-type headaches.
- it allows a provider to add time and benefit to his/her plan of care by using the apparatus as an extension of care outside the clinic.
- it cuts down on the need for pharmaceutical drugs that focus on symptom management for patients with tension-type headaches.
- it saves the patient the need for a return visit to their healthcare provider if able to self-treat in the case of a return of their tension-type headache pain.
- it meets a need in the marketplace for a self-treating apparatus that effectively mobilizes the upper neck using passive mobility and a specific blocking mechanism.

Although the above description contains much specificity, this should not be construed as limiting the scope of the embodiments but as merely providing illustrations of some of several embodiments.

Thus the scope of the embodiments should be determined by the appended claims and their legal equivalents, rather than by the examples given.

I claim:

1. A self-treatment neck mobilization device comprising:

a rectangular base comprising a rigid sheet of material and a longitudinal axis extending along a length of the base;

two adjustable stoppers attached to an upper surface of the base, the stoppers being configured to be located at a posterior aspect of a transverse process of a second cervical vertebra of a user in order to mobilize a C1-C2 segment;

a first pulley attached to a left side of the base and a second pulley attached to a right side of the base;

a head strap configured to be placed over the user's forehead while the user's head is resting on the base;

a rope attached to the head strap and extending through the first and second pulleys; and a handle on each end of the rope configured to allow the user to provide forces for nodding and rotating the user's head about the longitudinal axis of the base.

* * * * *